US006287136B1

(12) United States Patent
Deutsch

(10) Patent No.: US 6,287,136 B1
(45) Date of Patent: Sep. 11, 2001

(54) ELECTRICAL CONNECTOR SET

(75) Inventor: Peter K. Deutsch, Novato, CA (US)

(73) Assignee: Marinco, Napa, CA (US)

( * ) Notice: Subject to any disclaimer, the term of this patent is extended or adjusted under 35 U.S.C. 154(b) by 0 days.

(21) Appl. No.: 09/460,301

(22) Filed: Dec. 13, 1999

(51) Int. Cl.[7] ..... H01R 4/50

(52) U.S. Cl. ..... 439/337; 439/144; 439/271; 439/551

(58) Field of Search ..... 439/337, 673, 439/674, 551, 271, 142, 144

(56) References Cited

U.S. PATENT DOCUMENTS 3,123,423 * 3/1964 Schmitt ..... 439/674
4,060,299 * 11/1977 Williams ..... 439/551
4,199,207 * 4/1980 Lee ..... 439/674
5,120,237 * 6/1992 Fussell ..... 439/271
5,199,893 * 4/1993 Fussell ..... 439/271
5,823,833 * 10/1998 Castaldo ..... 439/851
6,123,578 * 9/2000 Truett ..... 439/551

* cited by examiner

*Primary Examiner*—Hien Vu
(74) *Attorney, Agent, or Firm*—Thomas R. Lampe

(57) ABSTRACT

A turn and lock electrical connector set including a receptacle having a recess, a plug including a projection for entering the recess and a seal located between the receptacle and the plug providing a fluid-tight seal between the receptacle and the plug when the electrical connectors of the receptacle and the plug are engaged.

5 Claims, 2 Drawing Sheets

ELECTRICAL CONNECTOR SET

TECHNICAL FIELD

This invention relates to an electrical connector set of the turn and lock type. The invention is applicable, for example, to provide an electrical connection in a marine environment, for example to provide an electrical connection to a trolling motor.

BACKGROUND OF THE INVENTION

Electrical connectors for trolling motors are subjected to vibration, and often rough usage as well, resulting in undesirable breaks in electrical transmission as well as deterioration of the electrical contacts employed in the plug and receptacle components thereof due to water or moist air intrusion.

It is known to provide locking arrangements which cooperate with a plug and a receptacle to keep these two components together as a unit. Typically, these locking arrangements utilize structure external of the plug and receptacle to accomplish this end. Lock mechanisms of this type are exposed and can be relatively easily damaged or otherwise rendered inoperative or less than optimally operative.

DISCLOSURE OF INVENTION

The present invention relates to an electrical connector set including a receptacle and plug which does not rely on exposed mechanisms to maintain a fluid-tight connection between the plug and receptacle. The invention is characterized by its simplicity, low cost and ease of use.

The receptacle of the invention includes a receptacle body having an outer plug engagement surface for engaging a plug and a recess, the recess being defined by an inner peripheral wall of the receptacle body extending inwardly from the plug engagement surface and an end wall of the receptacle body adjoining the inner peripheral wall and spaced from the plug engagement surface.

The receptacle additionally includes receptacle electrical connectors located in the receptacle body. The end wall defines a plurality of openings communicating with the receptacle electrical connectors.

The electrical connector set also includes a plug for selective attachment to the receptacle. The plug includes a plug body having an outer receptacle engagement surface for engaging the receptacle, a projection having a distal end projecting outwardly from the outer receptacle engagement surface and a plurality of plug electrical connectors extending outwardly from the distal end of the projection.

The projection is positionable in the recess of the receptacle to place the plug electrical connectors into the openings defined by the end wall of the receptacle. Subsequent relative rotational movement between the receptacle and the plug is effective to releasably lockingly engage the receptacle electrical connectors and the plug electrical connectors.

Also included in the electrical connector set is a seal located between the receptacle and the plug for providing a liquid-tight seal between the receptacle and the plug when the receptacle electrical connectors and the plug electrical connectors are releasably lockingly engaged.

Other features, advantages, and objects of the present invention will become apparent with reference to the following description and accompanying drawings.

BEST MODE FOR CARRYING OUT THE INVENTION

Figure 1:
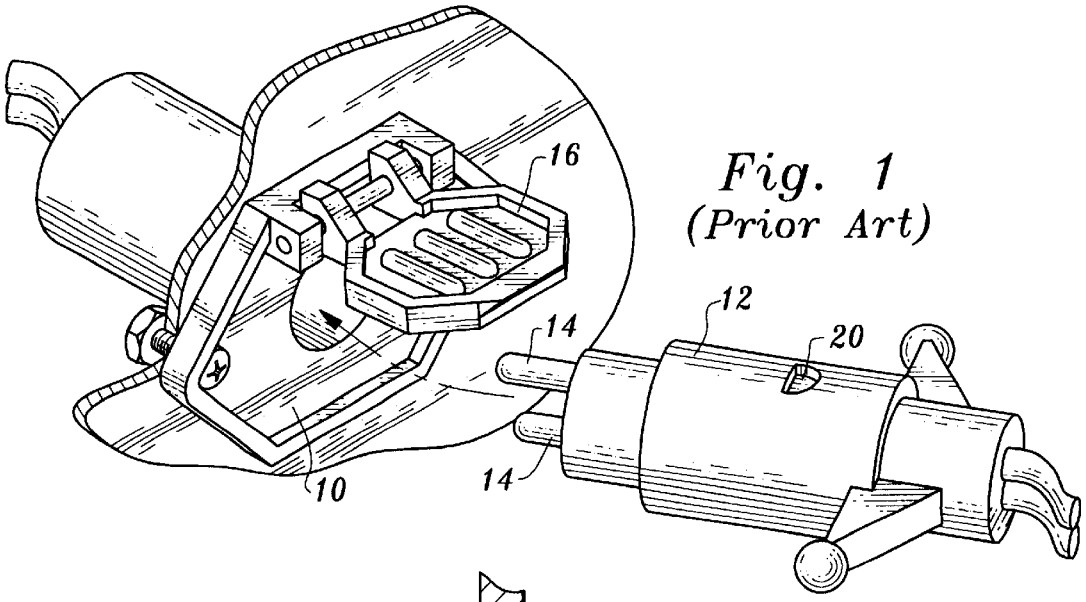
Fig. 1 (Prior Art)
FIG. 1 is a perspective view illustrating a plug and receptacle known in the prior art, the plug being shown just prior to insertion into the receptacle.
Figure 2:
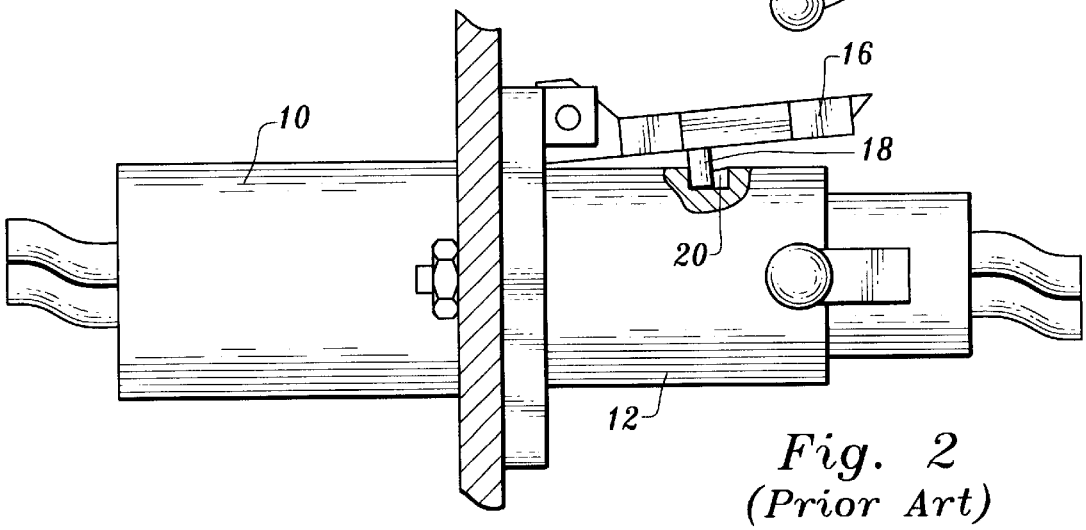
Fig. 2 (Prior Art)
FIG. 2 is a side elevational view of the electrical connector set of the prior art electrical connector set of FIG. 1 with the receptacle and plug connected and an external locking device being utilized to maintain such connection.
Figure 3:
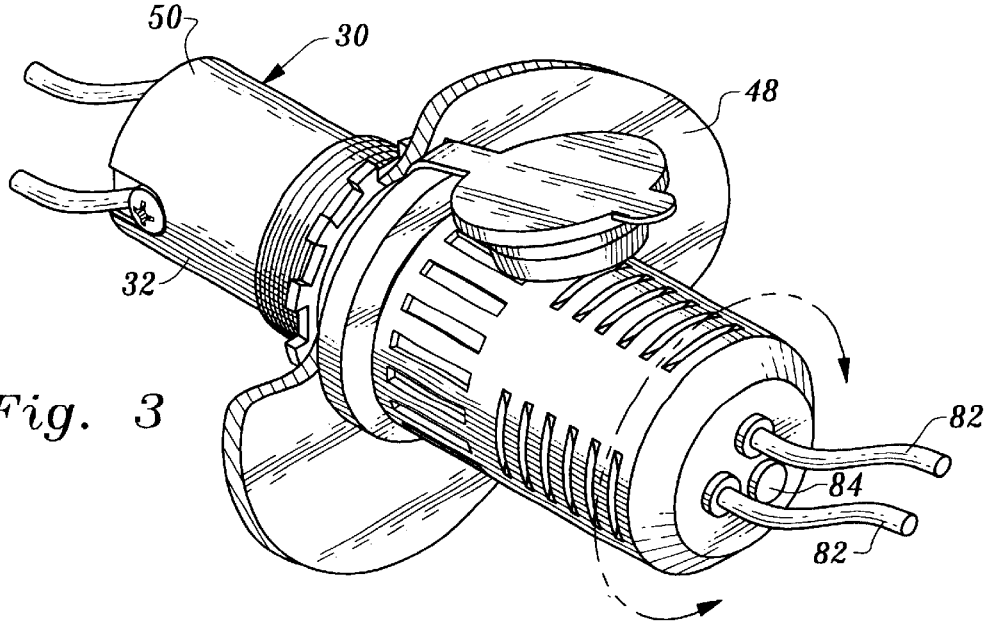
FIG. 3 is a perspective view of the twist-lock electrical connector set of the present invention, the receptacle and plug thereof being connected.
Figure 4:
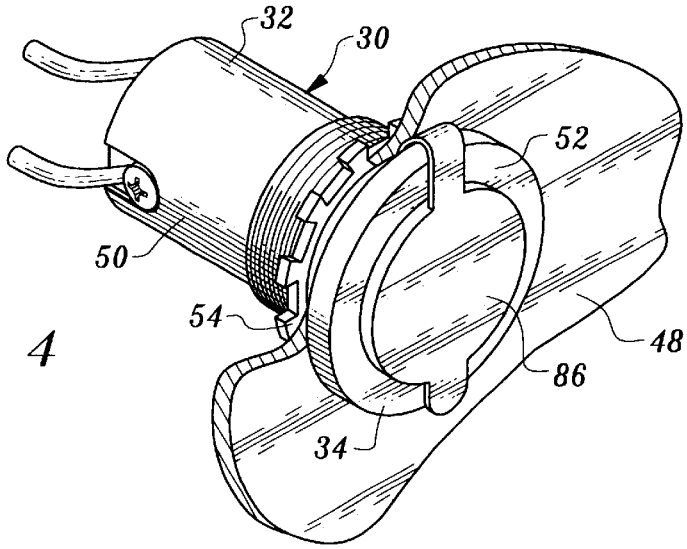
FIG. 4 is a perspective view of the receptacle mounted on a wall and closed by a protective cap.
Figure 5:
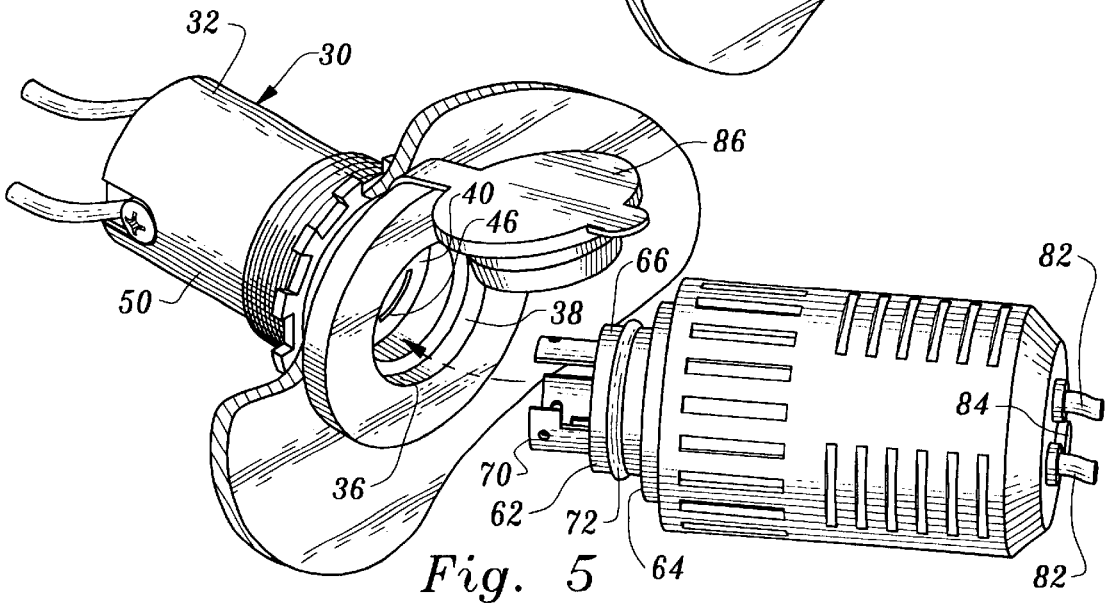
FIG. 5 is a perspective view illustrating the cap removed from the receptacle and the plug being positioned for insertion into the receptacle.
Figure 6:
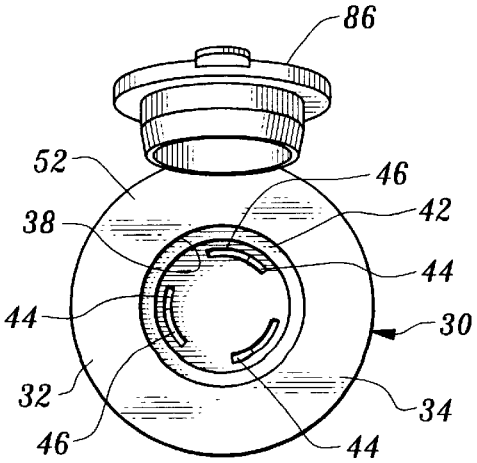
FIG. 6 is a front elevation view of the receptacle with the cover associated therewith in open position.
Figure 7:
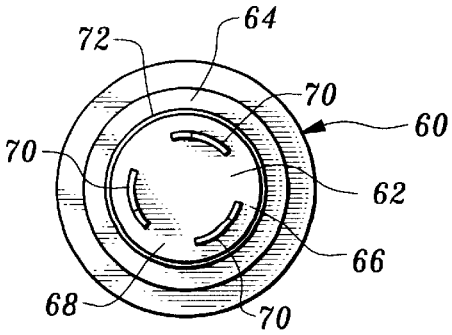
FIG. 7 is a front elevational view of the plug.

Referring now to FIGS. 1 and 2, a known prior art electrical connector set utilized in marine environments is illustrated. The connector set includes a receptacle 10 and a plug 12, the latter having electrical contact pins 14 which enter electrical sockets (not shown) within the interior of receptacle 10 when the plug is connected thereto as shown in FIG. 2. The prior art arrangement also includes a hinged cover 16 which closes the interior of the receptacle 10 when the plug is not positioned in the receptacle. The cover 16 is pivoted up as shown in FIGS. 1 and 2 when the plug and receptacle are engaged.

A lock pin 18 projects from the underside of the cover. The lock pin 18 is located in a recess 20 formed in the plug to prevent the plug from being inadvertently pulled out of the receptacle.

It will be appreciated that in such an arrangement accidental dislodgement of the lock pin from the recess 20 can occur. Furthermore, the exposure of this locking arrangement renders the components liable to damage either by being accidentally hit or through action of the moisture, dirt and other materials to which marine electrical connectors are routinely exposed.

Referring now to FIGS. 3–7, an electrical connector set constructed in accordance with the teachings of the present invention is illustrated. The electrical connector set includes a receptacle 30 including a receptacle body 32 formed of thermoplastic material such as nylon or the like having an outer plug engagement surface 34.

A recess 36 is formed in the plug body. The recess is defined by inner peripheral wall 38 extending inwardly from the plug engagement surface and an end wall 40 adjoining the inner peripheral wall and spaced from the plug engagement surface. The inner peripheral wall 38 forms a radial ledge or step 42.

The receptacle 30 also includes receptacle electrical connectors 44 which communicate with curved slits or openings 46 which are formed in end wall 40 of the receptacle body.

In the arrangement illustrated, the receptacle 30 is attached to a wall or bulkhead 48. More particularly, the receptacle body includes two portions 50 and 52 which are disposed on opposed sides of the wall and threadedly secured together. A lock washer 54 may also be utilized.

The electrical connector set also includes a plug 60 for selective attachment to the receptacle. The plug 60 includes a plug body 62 formed of thermoplastic material such as nylon or other suitable material. The plug body has an outer receptacle engagement surface 64 for engaging the outer plug engagement surface 34 of the receptacle when the plug and receptacle are secured together.

A projection or boss 66 having a distal end 68 projects outwardly from the outer receptacle engagement surface. A plurality of electrical connector blades 70 extend outwardly from the distal end of the projection.

The projection 66 has a cylindrically-shaped outer peripheral wall. The projection is positionable in the recess 36 of the receptacle 30 to place the plug electrical connectors 70 into the openings 46 defined by the end wall of the receptacle, with subsequent relative rotational movement between the receptacle and the plug being effective to releasably lockingly engage the receptacle electrical connectors and the plug electrical connectors. Electrical connectors of the turn and lock type employed in the receptacle and the plug are known per se and need not be described in detail. Turn and lock electrical or connectors sets per se employing these types of connectors are also known.

An O-ring constructed of suitable resilient material such as butyl rubber is disposed about projection 66. The O-ring 72 is seated in a radial recess formed about the periphery of projection 66. When the receptacle electrical connectors and the plug electrical connectors are releasably lockingly engaged, as described above, the O-ring seal 72 will bear against radial ledge or step 42 to form a liquid-tight seal to prevent passage of any water or other liquid to the connectors. Of course, the engagement between outer plug engagement surface 34 and outer receptacle engagement surface 64 will also serve to keep the recess 36 free of water to some extent. Not only is a water-tight interconnection established, relative movement between the receptacle and the plug is prevented. This is not only due to the engagement of surfaces 34 and 64 but also the interconnection between the electrical connectors 44 and 70, engagement of the projection 66 with the receptacle walls defining recess 20, and the engagement of the O-ring 72 with ledge 42.

A protective cover 80 formed of rubber, soft plastic or the like is positioned over the plug body of plug 60 so that the plug body is protected from the elements. The protective cover 80 defines openings through which electrical wires 82 pass. The cover includes a cover plug 84 which is attached to the remainder of the protective cover by an area of weakness or other form of frangible interconnection, the cover plug covering a third wire access opening (not shown) which can be exposed by removing the cover plug if a third wire is employed with the plug 60.

The plug 60 can be removed from the receptacle 30 merely by manually engaging the plug and applying a twisting force thereto to disengage the electrical connectors. A protective cap 86 is connected to the receptacle for covering the recess 36 when the plug 60 is not connected to the receptacle 30.

What is claimed is:

1. A turn and lock electrical connector set comprising, in combination:

a receptacle including a receptacle body having a lock washer thereon and an outer plug engagement surface for engaging a plug and a recess, said recess being defined by an inner peripheral wall of said receptacle body extending inwardly from said outer plug engagement surface and an end wall of said receptacle body adjoining said inner peripheral wall and spaced from said outer plug engagement surface, said receptacle additionally including receptacle electrical connectors located in said receptacle body, said end wall defining a plurality of openings communicating with said receptacle electrical connectors;

a plug for selective attachment to said receptacle, said plug including a plug body having an outer receptacle engagement surface for engaging the receptacle, a projection having a distal end projecting outwardly from said outer receptacle engagement surface and a plurality of plug electrical connectors comprising spaced lock blades extending outwardly from the distal end of said projection, said projection being positionable in the recess of said receptacle to place said plug electrical connectors into the openings defined by the end wall of said receptacle, and subsequent relative rotational movement between said receptacle and said plug being effective to releasably lockingly engage said receptacle electrical connectors and said plug electrical connectors to prevent the plug from being pulled from the receptacle and to maintain the projection in sealing engagement with the inner peripheral wall of said receptacle body; and a seal comprising an O-ring seal disposed about said projection located between the receptacle and the plug for providing a liquid-tight seal between the receptacle and the plug when said receptacle electrical connectors and said plug electrical connectors are releasably lockingly engaged, said projection comprising a boss having a cylindrically-shaped outer peripheral wall, said outer plug engagement surface and said outer receptacle engagement surface being in engagement to resist passage of liquid into said recess when said receptacle electrical connectors and said plug electrical connectors are releasably lockingly engaged, and the inner peripheral wall of said receptacle body forming a flat radially inwardly projecting ledge engaged by said O-ring seal when said receptacle electrical connectors and said plug electrical connectors are releasably lockingly engaged to form a liquid-tight seal to prevent passage of liquid to said plug and receptacle electric connectors.

2. The turn and lock electrical connector set according to claim 1 wherein said plug additionally comprises a protective cover located over said plug body.

3. The turn and lock electrical connector set according to claim 2 wherein said protective cover includes a selectively removable cover plug covering a wire access opening in said cover.

4. The turn and lock electrical connector set according to claim 1 additionally comprising a protective cap connected to said receptacle for covering the recess of said receptacle when said plug is not connected to said receptacle.

5. The turn and lock electrical connector set according to claim 1 wherein said O-ring seal is formed of butyl rubber.

* * * * *